United States Patent [19]

Obara

[11] Patent Number: 4,599,078

[45] Date of Patent: Jul. 8, 1986

[54] TRANSFORMABLE TOY ASSEMBLY

[75] Inventor: Hiroyuki Obara, Tokyo, Japan

[73] Assignee: Takara Co., Ltd., Tokyo, Japan

[21] Appl. No.: 692,829

[22] Filed: Jan. 18, 1985

[30] Foreign Application Priority Data

May 30, 1984 [JP] Japan ..... 59-110531

[51] Int. Cl.[4] ..... A63H 17/00

[52] U.S. Cl. ..... 446/95; 446/97; 446/376; 446/434; 446/487

[58] Field of Search ..... 446/93–95, 446/97, 99, 101, 376, 434, 435, 465, 487, 489, 427, 428

[56] References Cited

U.S. PATENT DOCUMENTS 4,095,367 6/1978 Ogawa ..... 446/290 X
4,170,840 10/1979 Ogawa .
4,206,564 6/1980 Ogawa ..... 446/94
4,411,097 10/1983 Murakami .
4,516,948 5/1985 Obara ..... 446/95
4,530,670 7/1985 Ohno ..... 446/97 X

FOREIGN PATENT DOCUMENTS 57-60694 4/1982 Japan .
58-145694 9/1983 Japan .
59-8990 1/1984 Japan .
2128489 5/1984 United Kingdom ..... 446/95

*Primary Examiner*—Mickey Yu
*Attorney, Agent, or Firm*—Price, Gess & Ubell

[57] ABSTRACT

A transformable toy assembly is disclosed which provides at least two assembly elements separable and combinable with respect to each other and independently reversibly transformable between at least two forms different from each other. The assembly elements are combined together in various forms to provide forms different from each other.

11 Claims, 25 Drawing Figures

TRANSFORMABLE TOY ASSEMBLY

BACKGROUND OF THE INVENTION

1. Field of the Invention

This invention relates to a transformable toy assembly, and more particularly to a transformable toy assembly comprising a plurality of assembly elements which are separable and combinable with respect to one another and independently reversibly transformable between at least two forms different from each other.

2. Description of the Prior Art

A large number of various transformable toys such as a transformable vehicle toy, a transformable robotic humanoid toy and the like have been developed in the art and appeared on the market. Such transformable toys are disclosed in, for example, U.S. Pat. No. 4,382,347 issued to Murakami on May 10, 1983, U.S. Pat. No. 4,391,060 issued to Nakane on July 5, 1983 and U.S. Pat. No. 4,393,620 issued to Murakami on July 19, 1983. The prior art toys arouse children's surprise and interest in their motion and function.

However, the conventional transformable toys each have a disadvantage that assembly elements constituting each toy are not constructed to be independently reversibly transformable among a plurality of forms different from one another, thus, the combination of the assembly elements is not adapted to provide various forms different from one another. This results in the toys relatively soon losing their popularity.

Further, the toy industry is always striving to increase the novelty in play options available to a child.

Thus, it would be highly desired to develop a transformable toy assembly which is capable of providing the combination of assembly elements in various forms and highly increasing the novelty in play options available to children.

SUMMARY OF THE INVENTION

The present invention has been made in view of the foregoing disadvantage of the prior art and such a demand as described above in the toy industry.

In accordance with the present invention, there is provided a transformable toy assembly comprising a plurality of assembly elements separable and combinable with respect to one another; said assembly elements each being adapted to be independently reversibly transformed from one form into at least one different form by expansion and/or folding in a state separated from the remaining assembly elements; and said assembly elements each being adapted to be combined with at least one of the remaining assembly elements in at least two forms of said at least one remaining assembly element to provide forms different from one another.

In accordance with the present invention, there is also provided a transformable toy assembly comprising a first assembly element and a second assembly element separable and combinable with respect to each other: said first assembly element comprising an expandable block means, a first movable part swingably mounted on said block means so as to be shiftable between a first position and a second position, a pair of second movable parts each pivotally connected at one end thereof to the lower portion of said block means so as to be shiftable between a first position and a second position, a pair of third movable parts each pivotally connected to the other end of each of said second movable parts; whereby said first assembly element provides a tractor form when said block means is not expanded and said first, second and third parts are in the first positions and a robotic humanoid form when said first to third parts are in the second position: and said second assembly element comprising a base means, a pair of first movable parts each pivotally connected at one end thereof to each side of said base means so as to be shiftable between a first position and a second position, a pair of second bendable parts movably supported on said first movable parts so as to be slidable in the longitudinal direction thereof and rotatable with respect to said first movable parts, to thereby be shiftable among first to fourth positions, and a pair of third parts rotatably mounted on both sides of the other end of said base means so as to be shiftable between a first position and a second position; whereby said second assembly element provides a trailer form when said first to third parts are in the first positions, a launcher form when said first parts are in the first position, said second parts are in the second position and said third parts are in the first position, a base form when said first parts are in the second position, said second parts are in the third position and said third parts are in the first position, and a dock form when said first parts are in the second position, said second parts are in the fourth position and said third parts are in the second position: said first and second assembly elements being adapted to be combined together to provide a semitrailer form when said first element takes the form of said tractor and said second element takes the form of said trailer, an armed vehicle form when said first assembly element takes the form of said tractor and said second assembly takes the form of said launcher, and a large-sized robotic humanoid form when said first assembly element takes the form of said robotic humanoid and said second assembly element takes the form of said dock: said block means of said first assembly element being in a folded state when the combination of said first and second assembly elements provides said large-sized robotic humanoid form.

Accordingly, it is an object of the present invention to provide a transformable toy assembly which is capable of permitting assembly elements to be-independently reversibly transformable among a plurality of forms different from one another and providing the combination of the assembly elements in various forms different from one another.

It is another object of the present invention to provide a transformable toy assembly which comprises a first assembly element independently reversibly transformable between two forms different from each other and a second assembly element independently reversibly transformable among four forms different from one another and which is capable of allowing the two assembly elements to be combined together to provide at least three forms different from one another.

It is another object of the present invention to provide a transformable toy assembly which comprises a first assembly element independently reversibly transformable between a tractor form and a robotic humanoid form and a second assembly element independently reversibly transformable among a trailer, a launcher, a base and a dock and which is capable of allowing the two assembly elements to be combined together to provide a semitrailer form, an armed vehicle form and a large-sized robotic humanoid form.

It is a further object of the present invention to provide a transformable toy assembly which is capable of retaining a popularity with children for a long period of time.

It is still a further object of the present invention to provide a transformable toy assembly which is capable of highly increasing the novelty in play options available to children.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which like reference numerals designate like or corresponding parts throughout, wherein.

DETAILED DESCRIPTION OF THE PREFERRED EMBODIMENT

Now, a transformable or reconfigurable toy assembly according to the present invention will be described hereinafter with reference to the accompanying drawings.

Figure 24:
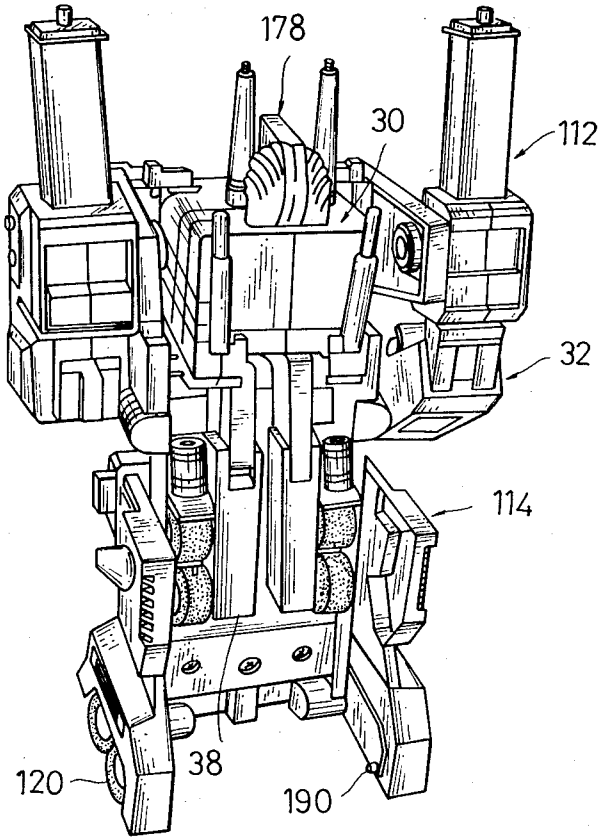
FIG. 24 is a rear perspective view of the robot shown in FIG. 23.

An embodiment of a transformable or reconfigurable toy assembly according to the present invention shown in the drawings is constructed to reversibly provide a vehicle form or semitrailer form, an armed vehicle form and a large-sized robotic humanoid form in an integrated state. The following description will be generally made in connection with the transformation from a semitrailer form shown in FIG. 2 through an armed vehicle form shown in FIG. 12 into a large-sized robotic humanoid form shown in FIG. 2, 23 and 24.

Figure 1:
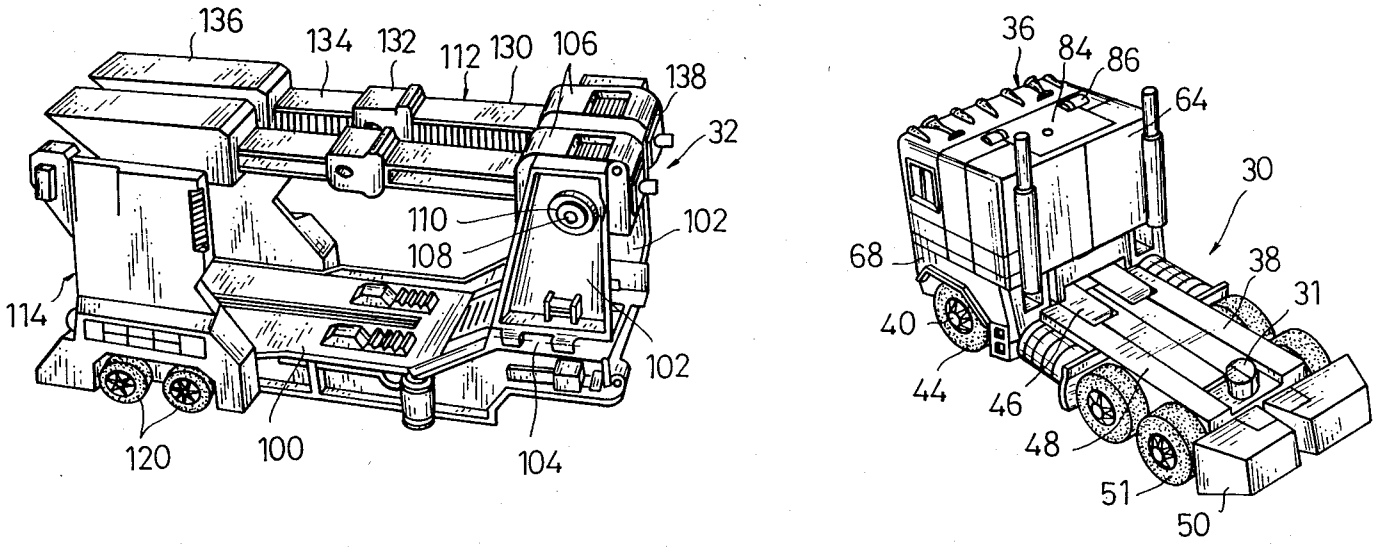
FIG. 1 is an exploded perspective view showing an embodiment of a transformable toy assembly according to the present invention, in which a first assembly element takes the form of a tractor and a second assembly element is in the form of a trailer.

The embodiment illustrated, as shown in FIG. 1, comprises a first assembly element 30 and a second assembly element 32 which are shown in a state separated from each other in FIG. 1. The first assembly element takes the form of a tractor and the second element is in the form of a trailer. The combination or coalescence between the first and second assembly elements is carried out by putting the front portion of the trailer 32 on the rear portion of the tractor 30 and securely fitting a projection 31 provided on the front portion of the trailer 32 in a hole 33 (FIGS. 17 and 19) formed at the rear portion of the tractor 30, so that a toy semitrailer generally designated by reference 34 in FIG. 2 may be formed.

Now, the first assembly element will be first described with reference to the drawings.

Figure 4:
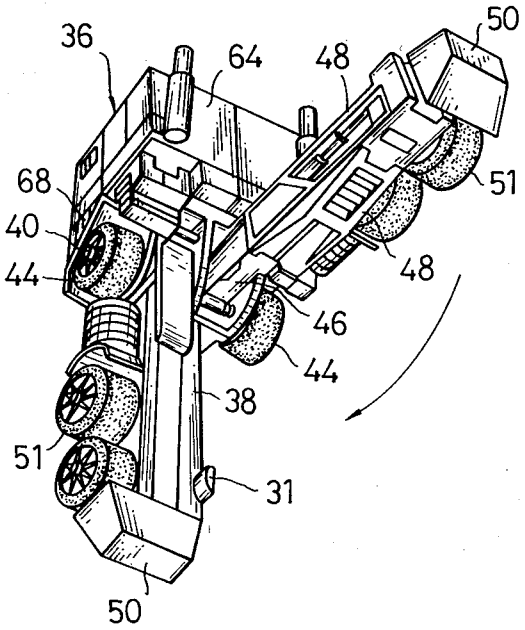
FIG. 4 is a bottom perspective view of the first assembly element of FIG. 1 showing a first step of transformation of the first assembly element from the tractor form shown in FIG. 1 into a robotic humanoid form shown in FIG. 9.

In the illustrated embodiment, the first assembly element 30 is constructed to be transformable between a tractor form and a robotic humanoid form, independently from the second assembly element. The first assembly element 30 comprises an expandable block means 36 having an appearance of a driver's stand in a tractor form and a pair of chassis 38 each pivotally connected at the forward portion thereof to a shaft 40 which is mounted on the lower portion of the block means 36 and rotatably supports a pair of front wheels 44 at both ends thereof. The chassis or part 38 each include a first member or part 46 which is connected at one end thereof to the shaft 40 and adapted to form an upper leg in a robotic humanoid form, a second member or part 48 which is pivotally connected at one end thereof to the other end of first member to rearward extend therefrom and adapted to form a lower leg in a robotic humanoid form, and a third member or part 50 pivotally connected to the other end of the second member 48 so as to be rotated within a range of 90 degree. The second members 48 each have a pair of rear wheels 51 rotatably mounted thereon. The pivotal movement of each of the chassis 38 about the shaft 40 from one position to another position in the downward or clockwise direction as shown in FIG. 4 and the rotation of the third member 50 to be positioned at 90 degree with respect to the second member 48 allow the chassis 38 to provide an appearance of a leg and foot section of a robotic humanoid form in such an upright state as shown in FIG. 5.

Figure 3:
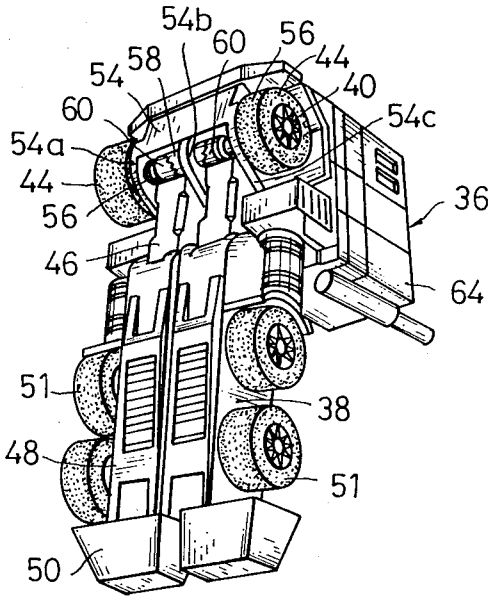
FIG. 3 is a bottom perspective view showing the bottom portion of the first assembly element of FIG. 1.

The shaft 40 is rotatably mounted on the lower portion of the block section 36 by means of a bearing means 52 which is provided at the lower portion of the block section 36. The bearing means 52, as shown in FIG. 3, comprises three supporting plate 54*a*, 54*b* and 54*c* spaced from one another at equal intervals, and a coiled spring 56 interposed between each adjacent two supporting plates and fitted on the shaft 40. The first members 46 of the chassis 38 are rotatably fitted at the forward ends thereof on the shaft 40 between the respective adjacent two supporting plates 54 in a manner to be forced toward the central supporting plate 54*b* by coiled springs 56 fitted on the shaft 40 and interposed between the outer supporting plates 54*a* and 54*c* and the forward ends of the first members 46. The central plate 54*b*, as shown in FIG. 3, is formed on both side surfaces thereof with steps 58, and correspondingly the first members 46 of the chassis 38 each are formed at the portion thereof facing the step 58 of the central plate 54*b* with a step 60 having a shape complementary to that of the step 58 so as to cause the rotation of the chassis 38 with respect to the block means 36 to be stopped at a desired angle. Also, the first member 46 of each of the chassis sections 38 is provided with a projection of a semi-circular shape (not shown) constantly forced toward the corresponding side supporting plate 54 (54*a* or 54*c*) to be abutted against the plate 54. The semicircular projection is adapted to be released from the side supporting plate 54 to be engaged with the periphery surface of the supporting plate 54 to keep the chassis section 38 at an upright state, when the chassis section 38 is rotated in the downward direction with respect to the block section 36 as shown in FIG. 5.

Figure 5:
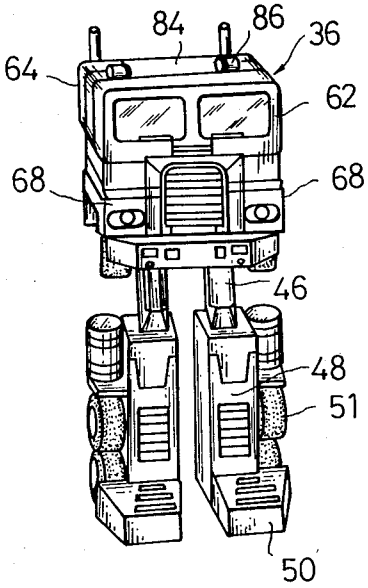
FIG. 5 is a front perspective view showing the first assembly element of FIG. 1 after completion of the first step of the transformation.
Figure 7:
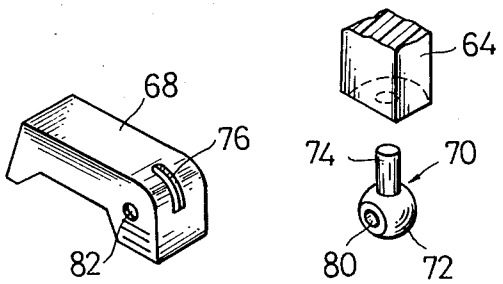
FIG. 7 is an exploded perspective view showing the relationships among a rear member, a wheel cover and a connecting member used in the first assembly element of FIG. 1.
Figure 6:
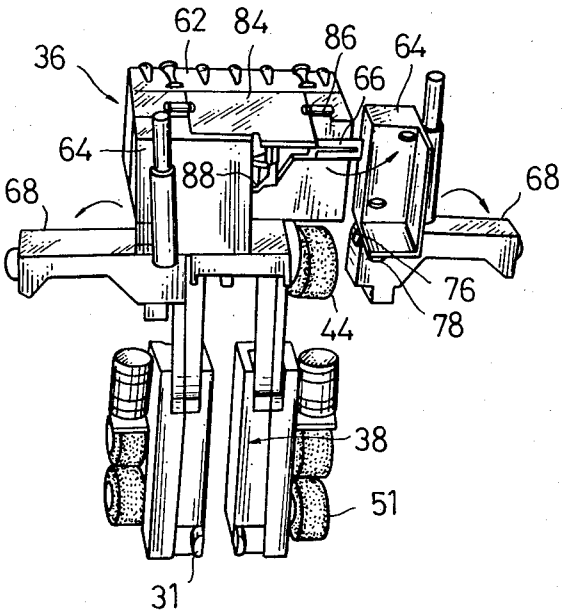
FIG. 6 is a rear perspective view of the first assembly element of FIG. 1 showing the manner of a second step of the transformation of the first assembly element.

The expandable block means or section 36 comprises a block body forming a driver's stand 62, a rear member 64 expandably and pivotally mounted to the rear portion of each side of the block body 62 through a connecting member 66, as shown in FIGS. 5 and 6. In the embodiment illustrated, the rear members 64 each form the rear portion of each side of the driver's stand 62. The connecting member 66 is connected at one end thereof to the side of the driver's stand 62 so as to be rotatable about the vertical axis, and the rear member 64 is connected to the other end of the connecting member 66 to be rotatable about the horizontal axis. The block means also comprises a front wheel cover 68 connected at the rear end thereof to the lower portion of each of the rear members 64 through a connecting member 70 so as to be rotatable about the vertical and horizontal axes. In the illustrated embodiment, the connecting member 70, as shown in FIG. 7, comprises a bearing 72 of a generally disc-like shape and a rod 74 upward extending from the bearing 72. The connection between the connecting member 70 and the front wheel cover 68 is carried out by receiving the bearing 72 in the front wheel cover 68 and movably inserting the rod 74 in an arcuate slit 76 of the front wheel cover 68, and connecting the bearing 72 and the front wheel cover 68 together by a pin 78 commonly fitted in a through-hole 80 of the bearing 72 and a through-hole 82 of the cover 68. Such construction allows the rear member 64 and front wheel cover 68 to be laterally expanded through the connecting members 66 and 70 as shown in FIG. 6, respectively. Further, the downward rotation of the front wheel cover 68 with respect to the rear member 64 in FIG. 6 results in the rear member 64 and the front wheel cover 68 exhibiting upper and lower arms of a robotic humanoid form in appearance, respectively, as shown in FIG. 8.

Figure 8:
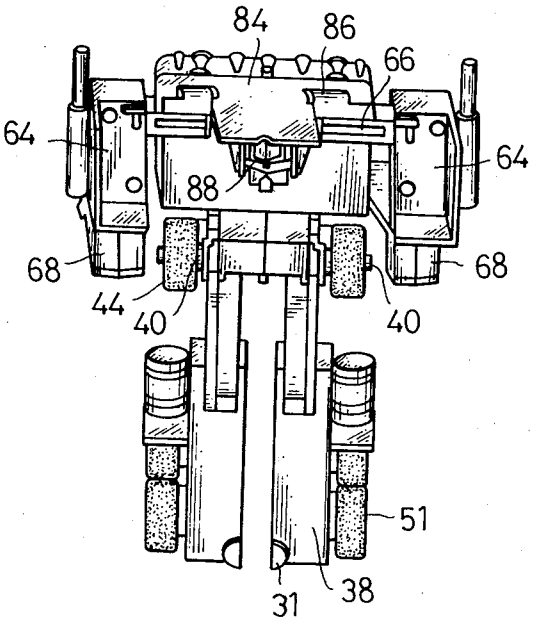
FIG. 8 is front perspective view of the first assembly element of FIG. 1 after completion of the second step of the transformation.

The driver's stand 62, as shown in FIGS. 6 and 8 has a top plate 84 pivotally connected to the central portion of the upper surface thereof by means of hinges 86, and the top plate 84 has a member or part 88 formed into a head shape of a robotic humanoid form and fixed on the lower surface thereof. In the state that the rear member 64 is not expanded, it prevents the top plate 84 being from rotated about the hinges 86, thus, the head member 88 is kept at a state or position received in the driver's stand 62. When the rear member 64 and front wheel cover 68 are once laterally expanded or pivotally moved as shown in FIG. 8, the rotation of the top plate 84 allows the head member 88 to be upward projected from the driver's stand to a position as shown in FIG. 9.

Thus, it will be noted that the first assembly element taking the form of a tractor in FIG. 1 is transformed into a robotic humanoid form which comprises upper arms formed by the rear members 64, lower arms formed by the front wheel covers 68, a trunk formed by the driver's stand 62, legs formed by the first and second members of the chassis sections 4, feet formed by the third members 50 of the chassis sections 38 and a head formed by the member 88.

The front wheel covers 68 each are formed at the front end thereof with an hole 90 in the form of a head lamp of the tractor, which also serves as a firing port for a missile, a projectile or the like when the tractor is transformed into the robotic humanoid form.

Figure 9:
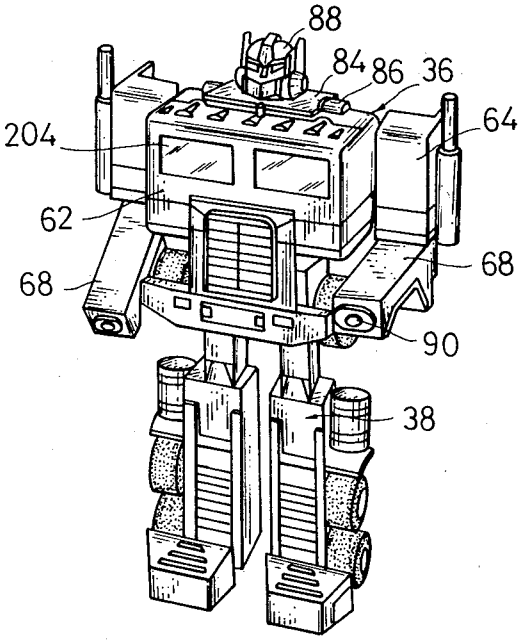
FIG. 9 is a front perspective view of the first assembly element of FIG. 1 after completion of the transformation into a robotic humanoid shape.

The robotic humanoid shape once formed as shown in FIG. 9 is transformed into the tractor form as shown in FIG. 1 by operating the respective members in a manner opposite to that described above.

As can be seen from the foregoing, the first assembly element 30 is reversibly transformed between the tractor form and the robotic humanoid form Now, the second assembly element 32 will be described hereinafter with reference to FIG. 1 and FIGS. 11 to 24.

Figure 11:
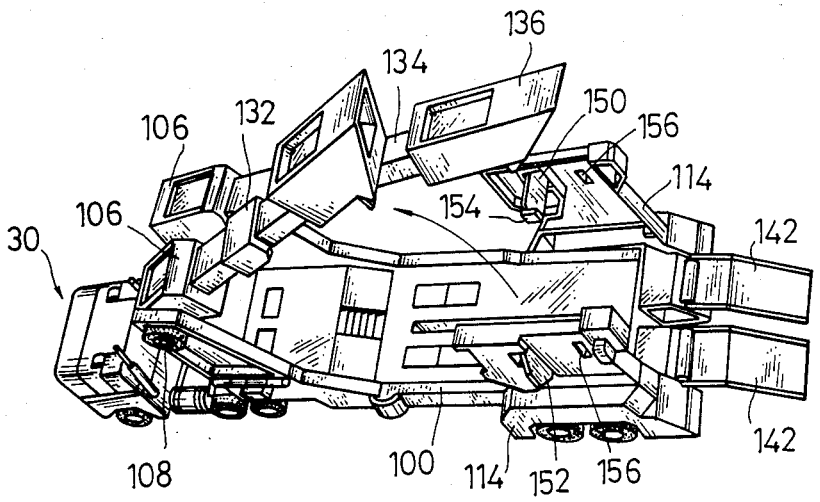
FIG. 11 is a top perspective view showing a first step of transformation of the second assembly element in the form of the trailer shown in FIG. 1, in which the second assembly element is mounted on the first element.
Figure 12:
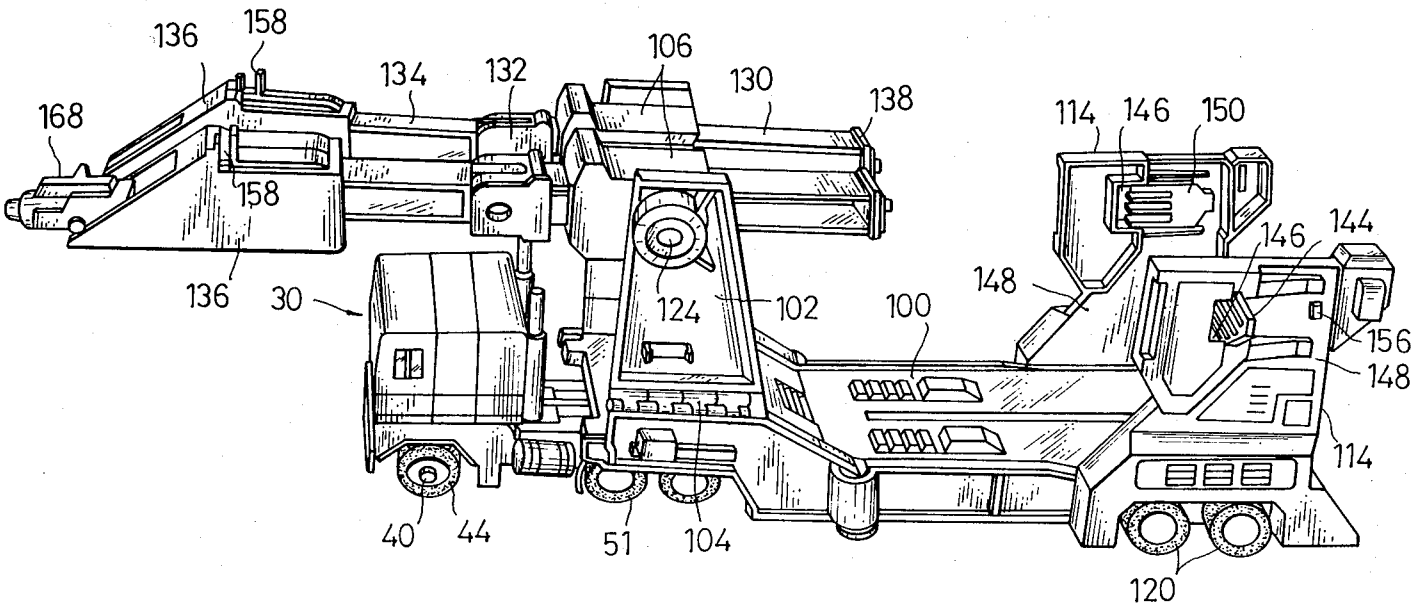
FIG. 12 is a side perspective view of the second assembly element of FIG. 1 which has been transformed into an armed vehicle.

The second assembly element 32, as shown in FIG. 1 and FIGS. 11 and 12, includes a chassis or base 100, a supporting member or part 102 pivotally mounted on each side of the front portion of the chassis 100 by means of a hinge 104 so as to be rotatable within a range of 180 degree, a beam holder 106 rotatably mounted at the upper end of each of the supporting members 102 through a laterally extending shaft 108 and a bearing 110 mounted on the supporting member 102, a longitudinally extending beam or part 112 slidably inserted through the beam holder 106, a wheel holder or part 114 rotatably mounted on each side of the rear portion of the chassis 100 through a laterally extending shaft 116 and a bearing 118 so as to be rotatable about the horizontal axis or the shaft 116, and a pair of wheels 120 rotatably supported on each of the wheel holders 114.

Figure 10:
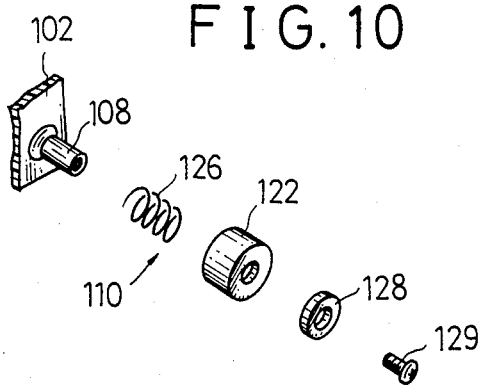
FIG. 10 is an exploded perspective view showing a bearing employed in the first assembly element of FIG. 1.

The bearings 110 and 118 are constructed in substantially the same manner. Accordingly, the bearing 110 is representatively described herein with reference to FIG. 10.

The bearing 110 comprises a cylindrical member 122 having a bored bottom and fixed on the supporting member 102, the shaft 108 inserted through the cylindrical member 122 so as to project at the distal end thereof from the bored bottom of the cylindrical member 122, a coiled spring 126 fitted on the shaft 108, and a stopper 128 fixedly mounted on the distal end of the shaft 108 by a screw 129, so that the beam holder 106 may be forced toward the supporting member 102 to be constantly abutted against it. The bearing 118 acts to abut the wheel holder 114 against the chassis 100. This allows the beam 112 and wheel holder 114 to be held at the respective desired rotational positions.

The beams 112 each comprise a first beam member 130 inserted through the beam holder 106 so as to be slidable in the longitudinal direction thereof and stopped at a desired position, a hinge member 132 connected to one end of the first arm member 130 so as to be rotatable about the longitudinal axis of the first beam member 130, a second beam member 134 connected at one end thereof to the hinge member 132 so as to be rotatable about the axis perpendicular to the longitudinal axis of the first beam member 130, and a block member 136 formed into a hand shape and fitted at a part thereof in the second beam member 134 so as to be slidable in the longitudinal direction of the second beam member 134 and stopped at a desired position. The first beam member 130 is provided at the free end thereof with a stopper 138 which acts to prevent the beam member 130 from being removed from the beam holder 106, and the second beam member 134 likewise is provided at the distal end thereof with a stopper 140 for preventing the hand member 136 from being removed from the second beam member 134.

The wheel holders 114 each have a footplate 142 pivotally attached to the rear portion thereof, which acts to allow a toy vehicle such as a miniaturized toy car to be transferred onto the chassis 100 therethrough from a floor on which the second assembly element or trailer 32 is put, when it is downward pivoted to the floor. This results in children taking more interest in the trailer because the transfer of a toy vehicle onto the chassis 100 from the floor is carried out not only directly by hand but while moving it through the footplates 142.

Further, each of the wheel holders 114 has a holding member 144 of an L-shape rotatably supported at the bending portion thereof in an aperture 146 formed at the upper section of a rising member 148 of the wheel holder 114. The holding member 144 is adapted to cause the inner holding portion 150 thereof to project in the direction perpendicular to the wheel holder 114 when the outer operating portion 152 of the member 144 outward projecting from the rising member 148 is pushed and cause the operating portion 152 to outward project to be operable when the inner holding portion 150 is pulled in the direction parallel to the wheel holder 114. The inner holding portion 150 is provided at the distal end thereof with a projection 154 as shown in FIG. 11, which is adapted to tightly fitted in a hole 156 formed at the rear portion of the rising member 148 of the wheel holder 114 when the holding portion 150 is pulled in. This results in the holding member 144 being kept at a stationary state. Thus, it will be noted that the wheel holders each also act to securely support the beam 112 thereon when the second assembly element takes the form of a trailer as shown in FIG. 1.

Figure 2:
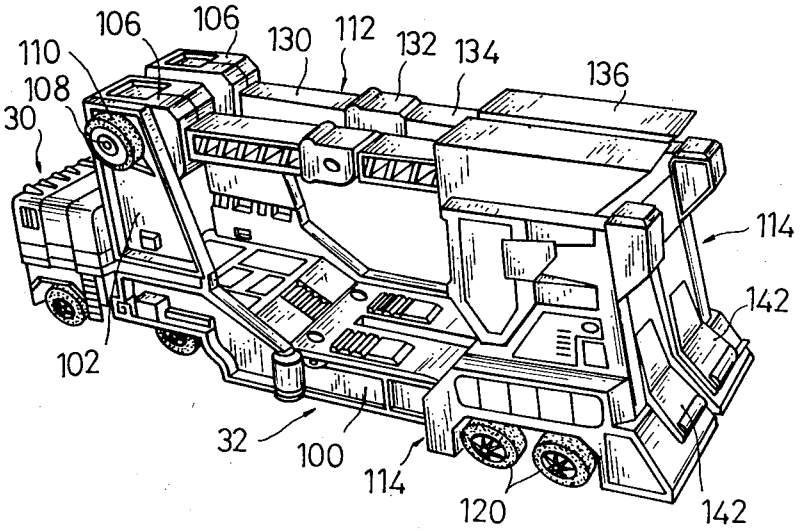
FIG. 2 is a perspective view of the first and second assembly elements shown in FIG. 1 which are combined with each other to provide a semitrailer form.

The block members 136 each are formed with a groove 158, which is adapted to be securely fitted on the inner holding portion 150 of the holding member 144 to keep the beam 112 at such a horizontal state as shown in FIGS. 1 and 2, when the beam 112 is rearward extended through the supporting member 102 by maximum distance and the hand or block member 156 is turned down while keeping the holding portion 150 at a projected state. Further, as clearly shown in FIG. 16, the beam holders 106 each are formed on the surface opposite to the opposite beam holder 106 with a projection 160 and a hole 162 which respectively securely fitted with respect to an opening 162 and a projection 160 of the opposite holder 106, and one of the block or hand members 136 is formed with a projection 164 on the side surface thereof which is opposed to the other hand member 136 when both hand members 136 are turned down, which is adapted to securely fitted in an opening 166 formed at the opposite surface of the opposite hand member 136. Such construction allows the supporting members 102, beams 112 and wheel holders 114 to be securely connected together and assembled into a rectangular shape or position, when the second assembly element takes the form of a trailer shown in FIG. 1.

The following description will be directed to transformation of the second element constructed in the manner described above from the trailer form shown in FIGS. 1 and 2 to various different forms with reference to the drawings.

First, the beams 29 each are forward rotated along a vertical plane about the shaft 108 as indicated with an arrow in FIG. 11. Then, each of the first beam members 130 is rearward slidedly moved with respect to the beam holder 106, each in a position as shown in FIG. 12, and a first attachment 168 taking the form of a projectile or missile is fitted through an opening 170 formed at the rear portion thereof on a projection 172 (FIG. 18) formed at the distal end of the second beam member 134. This results in the second assembly element 32 taking the form of the trailer shown in FIGS. 1 and 2 being transformed into a launcher form as shown in FIG. 12 which comprises a launcher cylinder constituted by the beam holders 106 and beams 112 and a launcher base constituted by the chassis 100. Such launcher form is combined with the first assembly element taking form of the track of FIG. 1 to provide an armed vehicle shown in FIG. 12.

Figure 14B:
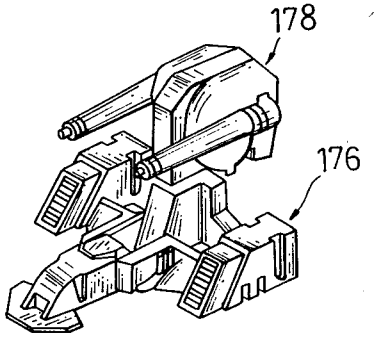
FIG. 14B is a perspective view showing the second attachment of FIG. 14A wherein the first and second parts are combined together to constitute a projectile.
Figure 14A:
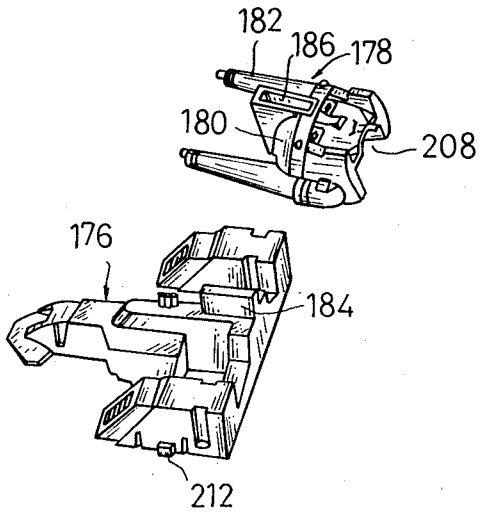
FIG. 14A is an exploded perspective view showing a second attachment to the second assembly element wherein the attachment is separated into first and second parts.
Figure 13:
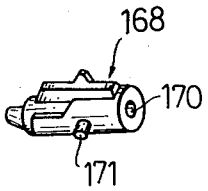
FIG. 13 is a perspective view showing a first attachment to the second assembly element.
Figure 15:
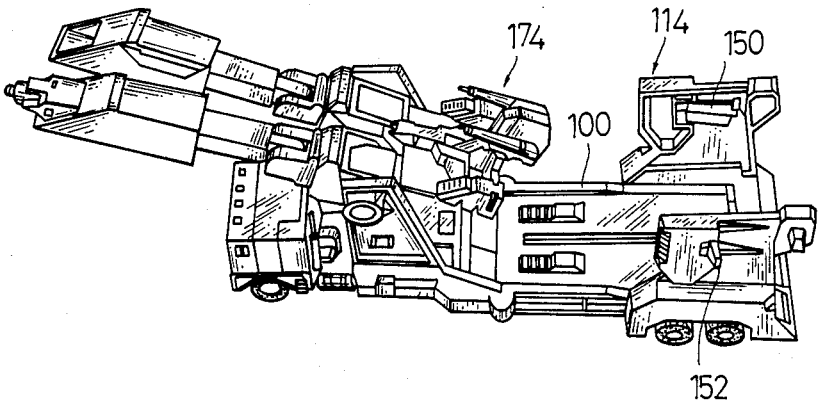
FIG. 15 is a top perspective view showing a modification of the armed vehicle shown in FIG. 12.

In this instance, the some rearward movement of the beams 112 through the beam holders 106 allows a space to be formed on the rear portion of each of the beams 112 which is sufficient to mount thereon a second attachment 174 taking the form of another projectile as shown in FIG. 15. The projectile 174 shown in FIG. 15 may comprise a first part 176 in the form of a projectile body and a second part 178 taking the form of a head of a robotic humanoid form putting on a helmet 180 and having gun-like rods or tubes 182 mounted on both sides of the helmet 180, as shown in FIGS. 14A and 14B. The removable connection between the first part 176 and second part 178 is carried out by fitting a projection 184 provided on the upper surface of the central portion of the first part 176 in an opening 186 formed at the front portion of the helmet 180 of the second part 178, resulting in the launcher having guns forward faced being formed. FIG. 15 shows the armed vehicle of FIG. 12 having the projectiles 168 and 174 mounted thereon wherein the launcher cylinder is obliquely upward lifted at the forward end thereof.

Figure 16:
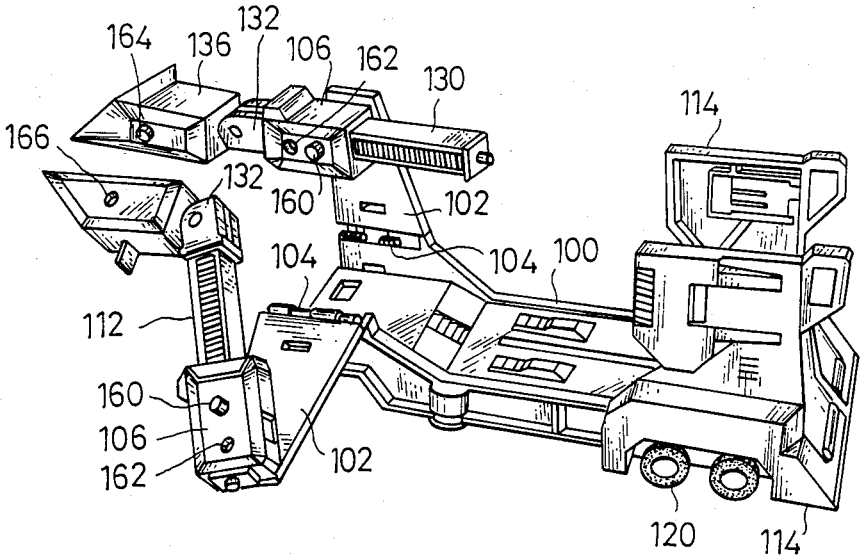
FIG. 16 is a perspective view of the second assembly element of FIG. 1 showing a step of transformation of the second assembly element from the armed vehicle shown in FIG. 12 into a base shown in FIG. 17.
Figure 17:
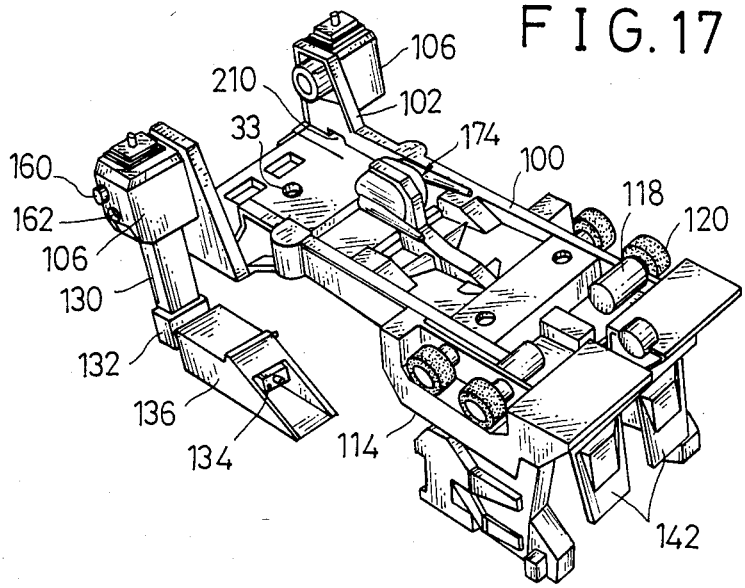
FIG. 17 is a perspective view of the second assembly element of FIG. 1 showing the transformation from the armed vehicle of FIG. 12 into a base.

Also, the second assembly element 32 itself may be further transformed from the trailer shown in FIG. 2 into such a base as shown in FIG. 17. More particularly, as shown in FIG. 16, the supporting members 102 each are downward reversibly rotated to a position through the hinge 104 in the state that the beam 112 is forward slidedly moved not to rearward project the first beam member 130 from the beam holder 106. Then, each of the beams 112 is rotated about the beam holder 106, the second beam member 134 is pivotally moved about the hinge member 132 to be bent with respect to the first beam member 130, and the second beam member 134 is rotated through the hinge member 132 to be upward faced thereby being in a position different from above. Subsequently, the chassis 100 is reversed to cause the lower surface thereof to be turned up as shown in FIG. 17. This results in the second assembly element 32 taking the form of such a base as shown in FIG. 17. The chassis 100 may be attached thereonto an attachment similar to the second attachment 174 taking the form of a projectile.

Figure 18:
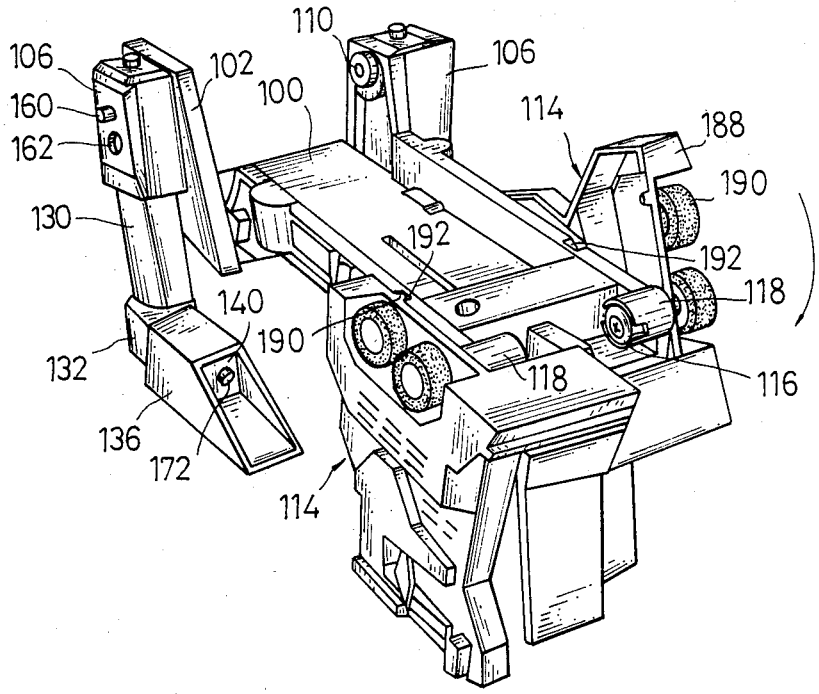
FIG. 18 is a perspective view of the second assembly element of FIG. 1 showing a step of the transformation from the base shown in FIG. 47 into a dock.

In the embodiment illustrated, the wheel holders 114 each is provided on the bottom portion 188 thereof with a projection 190 extending inward or toward the chassis 100 as shown in FIG. 18, which is adapted to be engaged with a cutout 192 formed at each side of the chassis 100 to prevent the wheel holder 114 from being unnecessarily rotated about the shaft 116.

In FIG. 17, the beam holders 106 each are positioned in such a manner that the connecting projection 160 and opening 162 are outward faced. Thus, a member similar to the first attachment 168 may be fittedly mounted on each of the beam holders 106 by fitting one of projections 171 provided on both sides of member in the opening 162 to provide a projectile on each side of the base.

Figure 19:
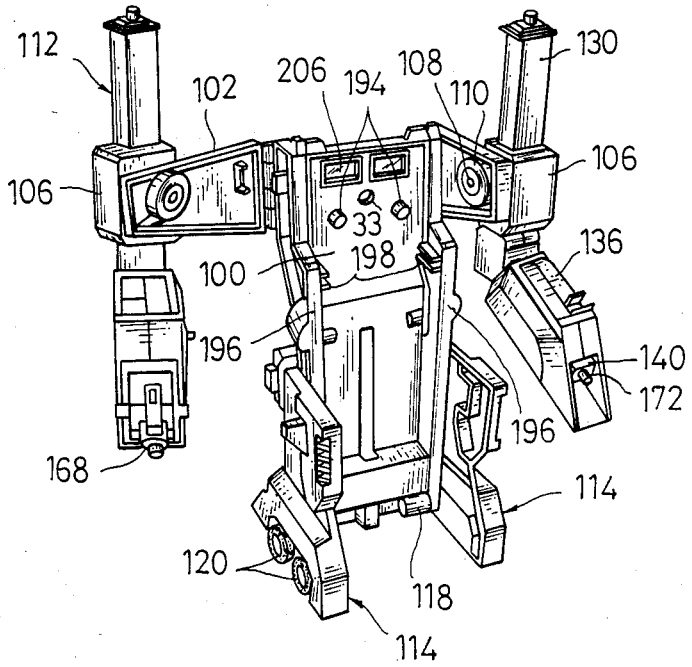
FIG. 19 is a perspective view of the second assembly element of FIG. 1 transformed into a dock.
Figure 20:
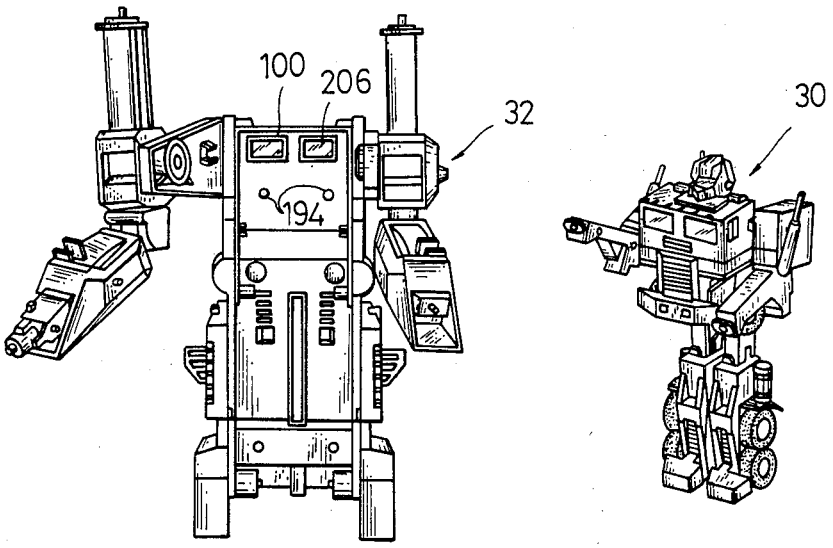
FIG. 20 is a perspective view showing one manner of the combination between first and second assembly elements shown in FIG. 1.

Furthermore, the second assembly element 32 may be transformed into a dock form as shown in FIGS. 19 or 20 in such a manner to rotate each of the wheel holders 114 in the direction and to a position indicated by an arrow in FIG. 18 to allow the upper portion of the rising member 148 of the wheel holder to approach to the forward portion of the chassis 100 or the supporting member 102 as shown in FIG. 18; concurrently stand the chassis 100 to downward position each of the wheel holders 114 and forward face the lower surface of the chassis 100, as shown in FIG. 19; forward rotate each of the beams 112 about the shaft 108 of the supporting member 102; to a position as shown in FIGS. 19 and 20 and then slidingly move each of the first beam members 130 through the beam holder 106 in the upward direction to a position as shown in FIGS. 19 and 20. In such a dock form shown in FIGS. 19 and 20, the second assembly element can be travelled because the wheels 120 are on a ground or floor.

Accordingly, when the robotic humanoid form of FIG. 9 obtained by the transformation of the first assembly element 30 and the dock form of FIG. 19 obtained by the transformation of the second assembly element are arranged side by side as shown in FIG. 20, a viewer will feel that the robot carries out any repairing operation on the dock.

Now, the manner of connection or coalescence between the first assembly element the robotic form shown in FIG. 9 and the second assembly element of the dock form will be described with reference to the drawings.

Figure 22:
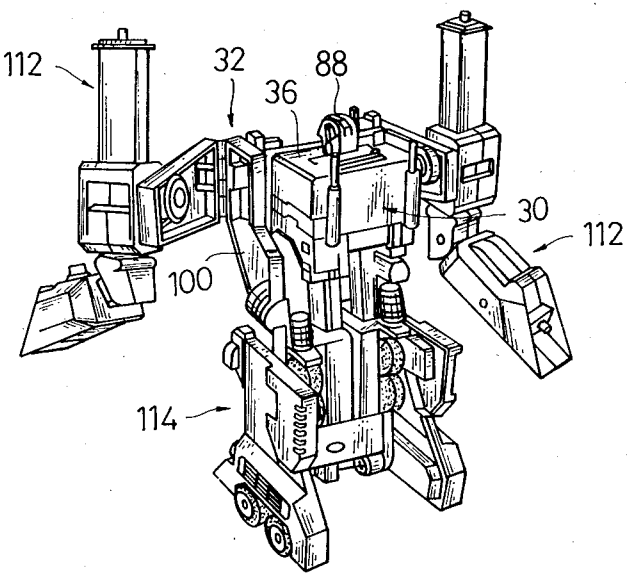
FIG. 22 is a perspective view of the first and second assembly elements of FIG. 1 combined together.
Figure 21:
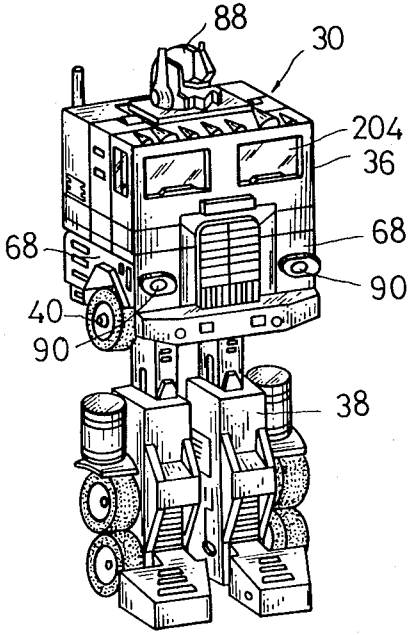
FIG. 21 is a perspective view of the first assembly element of FIG. 1 transformed into another form for the combination with the second assembly element.

The chassis 100 of the second assembly element 32 has a pair of projections 194 laterally provided on the lower surface of the front portion thereof as shown in FIGS. 19 and 20. Also, the chassis 100 is provided on both sides of the lower surface thereof with a pair of side walls 196 rearward extending from the vicinity of the projections 196, and the side walls 196 have a pair of opposite grooved projections 198 provided on the front portions thereof so as to extend in the horizontal direction in FIG. 19. Also, the first assembly element 30 is constructed in a manner such that when it is transformed into a robotic humanoid form shown in FIG. 21 wherein the block means 36 is folded or not expanded, it has dimensions sufficient to allow the front portion of the robot to be fitted between the side walls 196 of the lower surface of the chassis 100 shown in FIG. 19. Also, the first assembly element 30 is constructed to allow the holes 90 of the front wheel covers 68 to be fitted on the projections 194 of the lower surface of the chassis 100 of the second assembly element 32 and allow both distal ends 200 of the shaft 40 outward projecting from the front wheels 44 to be fitted in the grooves of the projections 198 of the side walls 196 of the chassis 100, when it is fitted between the side walls 196. Such construction permits the first assembly element transformed into the robot form to be securely fitted in the second assembly element 32 through the chassis 100 to carry out the combination or coalescence therebetween to form an outline of a large-sized robotic humanoid form, as shown in FIG. 22.

The first assembly element has a pair of front windows 204 formed at the front portion of the driver's stand 62, which are adapted to positionally align with through-holes 206 of a shape corresponding thereto formed at the front portion of the chassis 100 when such combination or coalescence is once carried out, so that the windows 204 appear as eyes of the robot from which a viewer can observe the exterior via the through-holes 206. Also, the combination of the first and second assembly elements 30 and 32 is carried out to allow the head member 88 upward projecting from the block means or section 36 to upward project from the upper end of the chassis 100 of the second assembly element 32 so as to form the head portion of the robot. Furthermore, the helmet 180 of the second part 178 described above has an opening 208 formed at the rear portion thereof, which is adapted to be fitted on the head portion 88 of the robot after the combination between the first and second assembly elements 30 and 32, to thereby form a head of a size suitable for the large-sized robotic humanoid form.

Figure 23:
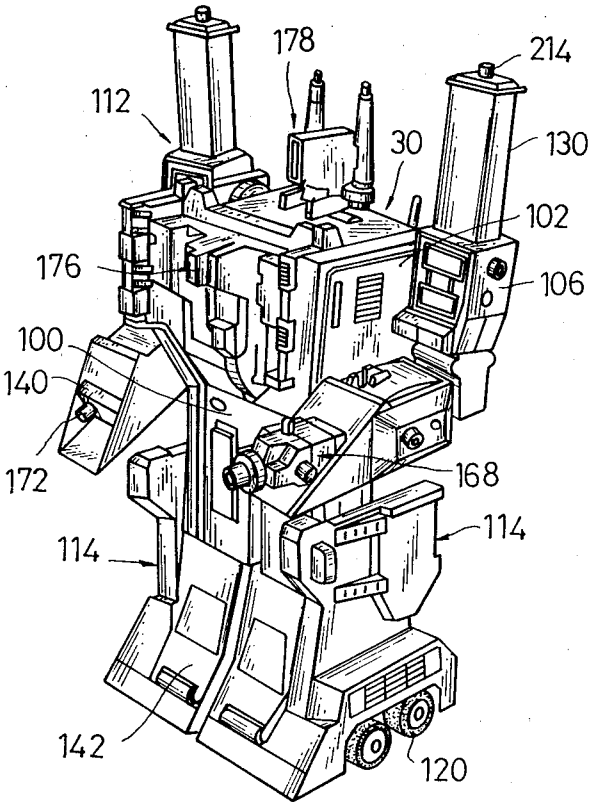
FIG. 23 is a perspective view showing a large-sized robotic humanoid form obtained by combination of the first and second assembly elements wherein a second attachment is fitted on the head portion of the so-formed robot.

The so-combined first and second assembly elements, when the front surface of the chassis 100 of the second assembly element is forward faced and the second beam members 134 of the arms 112 and the hand members 136 are rotated to be forward faced as shown in FIG. 23, constitute the large-sized robotic humanoid form finished in which the chassis 100 forms a trunk section of the robot, the wheel holders 114 form a pair of leg sections thereof, the supporting members 102 form a shoulder section thereof and the beams 112 form a pair of arm sections thereof.

The chassis may be formed at both side walls of the upper portion of the front surface thereof with holes 210 as shown in FIG. 17 in which projections 212 formed on both sides of the first part 176 as shown in FIG. 14A are fitted. This allows the first part 176 to serve as decoration for the chest portion of the robot. Even in this instance, the first attachment 168 having appearance of a projectile may be mounted on the distal end of the second beam or arm member 134. Likewise, the first beam or arm members 130 each may be provided at the free end thereof with a projection 214 similar to the projection 172 of the second arm member 134 so as to permit the mounting of a member similar to the member 168.

As described above, the embodiment illustrated is constructed in the manner that the first assembly element 30 is reversibly transformed between the tractor form and the robotic humanoid form in the state that it is separated from the second assembly element, the second assembly element can be alternatively transformed among the trailer form, base form and dock form in the state that it is separated from the first assembly element, and the combination or coalescence between the first and second assembly elements selectively provides the semitrailer form, armed vehicle form or large-sized robotic humanoid form which is highly different in shape from the above-mentioned configurations obtained by the respective first and second elements. Thus, it will be noted that the embodiment illustrated can carry out the reversible transformation to provide various variations in form, which has a great interest for children and provides intellectual training to children.

As can be seen from the foregoing, the reconfigurable toy assembly according to the present invention allows children to enjoy various transformations full of a variety.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A transformable toy assembly having at least two assembly elements that are separable and combinable with each other, each being independently reversibly and transformable between different positions to provde different forms of a toy, comprising:

a first assembly element having component parts adapted to be reversibly transformable between a tractor truck form and a robotic humanoid form; and a second assembly element having component parts adapted to be reversibly transformable among a trailer truck form, a launcher form, a base form and a dock form, whereby combining the first and second assembly elements provides a semitrailer truck form when the first element takes the form of said tractor and said second element takes the form of said trailer, an armed vehicle form when said first element takes the form of said tractor and said second element takes the form of said launcher, and a large-sized robotic humanoid form when said first assembly element takes the form of said robotic humanoid and said second assembly element takes the form of said dock.

2. The invention of claim 1 wherein the first assembly element comprises:

a block means for simulating a driver's stand of the truck in a first position or a robotic trunk and pair of arms in a second position;

a first movable part swingably mounted to the block means and physically conformed to simulate a cabin top of the truck in a first position or a robotic head in a second position; and a pair of second movable parts pivotally connected to the block means and physically conformed to simulate a first chassis of the truck in a first position or a pair of robotic legs in a second postion.

3. The invention of claim 1 wherein the second assembly element comprises:

a base means for simulating a second chassis of the truck in a first position or a launcher base in a second position;

a pair of first movable parts pivotally connected at the sides of the base means and physically conformed to simulate supports for a pair of beams in a first position or supports for a pair of launcher cylinders in a second position; and a pair of second parts rotably mounted on two sides of the base means and physically conformed to simulate a pair of wheel holders for the truck in a first position and a pair of robotic legs in a second position.

4. A transformable toy assembly having a first and second assembly elements separable and combinable with each other, and each having component parts movable into at least two positions for forming at least a semitrailer truck form, and a robotic humanoid form, comprising:

a block means in the first assembly physically conformed to simulate a driver's stand of the truck in a first position or a robotic trunk and pair of arms in a second position;

a first movable part swingably mounted to the top portion of the block means and physically conformed to simulate a cabin top of the truck in a first position or a robotic head in a second position;

a pair of second movable parts pivotally connected to the lower portion of the block means and physically conformed to simulate a first chassis of the truck in a first position or a pair of robotic legs in a second position;

a pair of third movable parts pivotally connected to the second parts at the ends thereof opposite the base means and physically conformed to simulate a chassis part of the truck in a first position or a pair of robotic feet in a second position;

a base means in the second assembly physically conformed to simulate a second chassis of the truck in a first position or a launcher base of a projectile launcher in a second position;

a pair of fourth movable parts pivotally connected at two opposing sides of the base means and physically conformed to simulate supports for a pair of beams in a first position or supports for a pair of launcher cylinders in a second position;

a pair of fifth movable parts movably supported on the fourth parts and physically conformed to simulate a pair of upper beams in a first position or the pair of launcher cylinders in a second position;

a pair of sixth parts rotatably mounted on the same two sides of the base means as are the fourth parts and physically conformed to simulate a pair of wheel holders of the truck in a first position or simulating a pair of robotic legs in a second position.

5. The invention of claim 4 wherein the block means comprises:

a pair of rear members physically conformed to simulate the back portions of the driver's stand in a first position and a pair of upper robotic arms in a second position; and a pair of wheel covers pivotally connected to the rear members and physically conformed to simulate a pair of wheel covers of the truck in a first position and a pair of lower robotic arms in a second position.

6. The invention of claim 4 wherein the fifth parts are configured to receive and hold at least one toy simulating a projectile launcher.

7. The invention of claim 4 further comprising a pair of footplates rotatably mounted at one end of the base means and physically conformed to simulate a pair of wheel guides in a first position and received in the base means in a second position.

8. The invention of claim 4 wherein the first assembly is transformable between a tractor truck form and a robotic humanoid form, the second assembly is transformable between a trailer truck, a launcher, a base, and a dock forms, and the first and second assemblies are combinable to be transformable between a semitrailer truck, an armed vehicle and a large-sized robotic humanoid forms.

9. A transformable toy assembly capable of being formed into at least a robot toy and a vehicle toy, comprising:

a first assembly element having an expandable block means, a first movable part swingably mounted on said block means so as to be shiftable between a first position and a second position, a pair of second movable parts each pivotally connected at one end thereof to the lower portion of said block means and shiftable between a first position and a second position, and a pair of third movable parts each pivotally connected to the other end of each of said second movable parts, whereby said first assembly element provides a tractor vehicle form when said first, second, and third parts are in the first positions and a robotic humanoid form when said first to third parts are in the second positions; and a second assembly element having a base means, a pair of first movable parts each pivotally connected at one end thereof to each side of one end of said base means so as to be shiftable between a first position and a second position, a pair of second bendable parts movably supported on said first movable parts so as to be slidable in the longitudinal direction thereof and rotatable with respect to said first movable parts, to thereby be shiftable among first through fourth positions, and a pair of third parts rotatably mounted on both sides of the other end of said base means so as to be shiftable between a first position and a second position, whereby said second assembly element provides a trailer vehicle form when said first to third parts are in the first positions; a launcher form when said first parts are in the first position, said second parts are in the second position, and said third parts are in the first position; a base form when said first parts are in the second position, said second parts are in the third position, and said third parts are in the first position; and a dock form when said first parts are in the second position, said second parts are in the fourth position, and said third parts are in the second position, whereby the combination of said first and second assembly elements provide a semitrailer truck form when said first element takes the form of said tractor and said second element takes the form of said trailer, an armed vehicle when said first element takes the form of said tractor and second element takes the form of said launcher, and a large-sized robotic humanoid form when said first element takes the form of said robotic humanoid and second element takes the form of said dock; said block means constitutes a driver's stand having front wheels and said second parts and third parts of said first element constitute a first chassis having at least a pair of rear wheels when said first assembly element takes the form of said tractor; said block means constitutes a trunk and a pair of arms, said first part of said first assembly element constitute a head, said second parts of said first assembly element constitute a pair of legs, and said third parts of said first assembly element constitute a pair of feet when said first assembly element takes the form of said robotic humanoid for; and said base means constitutes a second chassis, said second parts of said second assembly element constitute upper beams, said first parts of said second assembly element constitute a supporting means for said upper beams, and said third parts of said second assembly element constitute a pair of wheel holders each having at least one wheel when said second assembly element takes the form of said trailer; said base means constitutes a launcher base, said second parts of the said second assembly constitute a pair of launcher cylinders, and said first parts of said assembly constitute a supporting means for said launcher cylinder when said second assembly element takes the form of said launcher; and said base means constitutes a trunk for receiving said first assembly element, said second parts of said second assembly element constitute a pair of arms, said first parts of said second assembly element constitute supporting means for rotatably supporting said second parts of said second assembly element and said third parts of said second assembly element constitute a pair of legs when the combination of said first and second assembly elements provides said large-sized robotic humanoid form.

10. A transformable toy assembly as defined in claim 9 wherein said block means comprises a pair of block bodies, a pair of rear member pivotally connected to both sides of the rear portion of said block, a pair of cover members each vertically and horizontally pivotally connected to the lower portion of each of said rear members which serve to cover a wheel of said block means, said wheel of said block means being mounted on the lower portion of said block means.

11. A transformable toy assembly as defined in claim 10 wherein said expandable rear members and cover members of the block means of said first assembly element are in a folded state when the combination of said first and second assembly elements provides said large-sized robotic humanoid form.

* * * * *